United States Patent [19]

Jongen et al.

[11] Patent Number: 4,771,208

[45] Date of Patent: Sep. 13, 1988

[54] CYCLOTRON

[76] Inventors: Yves Jongen, rue de Castinia, 13/302, B-1348 Louvain-La-Neuve; Guido Ryckewaert, Middelweg, 164 B-303 Heverlee, both of Belgium

[21] Appl. No.: 10,280

[22] PCT Filed: Apr. 30, 1986

[86] PCT No.: PCT/BE86/00014

§ 371 Date: Dec. 29, 1986

§ 102(e) Date: Dec. 29, 1986

[87] PCT Pub. No.: WO86/06924

PCT Pub. Date: Nov. 20, 1986

[30] Foreign Application Priority Data

May 10, 1985 [LU] Luxembourg ..... 85895

[51] Int. Cl.[4] ..... H05H 13/00

[52] U.S. Cl. ..... 313/62; 328/234

[58] Field of Search ..... 313/62; 328/234

[56] References Cited

U.S. PATENT DOCUMENTS

| | | | |
|---|---|---|---|
| 3,175,131 | 3/1965 | Burleigh et al. | 313/62 X |
| 3,789,335 | 1/1974 | Delphin et al. | 313/62 X |
| 4,445,102 | 4/1984 | Thorn et al. | 313/62 X |

FOREIGN PATENT DOCUMENTS

| | | | |
|---|---|---|---|
| 1564303 | 6/1972 | Fed. Rep. of Germany | 328/234 |
| 2176485 | 11/1973 | France . | |
| 1485329 | 9/1977 | United Kingdom | 313/62 |
| 0747396 | 12/1983 | U.S.S.R. | 328/234 |

OTHER PUBLICATIONS

"The JINR U-400 Isochronous Heavy Ion Cyclotron" by B. N. Markov, *IEEE Transactions on Nuclear Science*, vol. NS-24, No. 3, Jun. 1977, pp. 1215-1217.

*Primary Examiner*—Palmer C. DeMeo

*Attorney, Agent, or Firm*—Fishman, Dionne & Cantor

[57] ABSTRACT

A non-superconductive cyclotron comprises a magnetic circuit comprising at least three sectors called "hills", wherein the air-gap is reduced to a size similar to that of the accelerated beam and wherein the magnetic flux is substantially concentrated. The hills are separated by spacings configured like sectors called "valleys" wherein the air-gap is a very large size so that the magnetic flux is essentially null. The magnetic circuit is further comprised of a single pair of coils which are substantially circular and surround the hills and valleys.

10 Claims, 1 Drawing Sheet

CYCLOTRON

BACKGROUND OF THE INVENTION

The present invention relates to a traditional cyclotron of a new design, which permits a substantial reduction of the energy requirements.

The known cyclotrons are of two types: cyclotrons making use of superconductive windings (superconductive cyclotrons) and cyclotrons making use of non-superconductive windings (traditional cyclotrons).

The superconductive cyclotrons do not make use of electrical power for the purpose of sustaining the magnetic field required for the acceleration of the particles. However, the technology of the superconductive windings and of the associated cryogenics remains complex and costly. Furthermore, these windings require liquid helium as refrigerating fluid. These considerations restrict to a great extent the use of superconductive cyclotrons.

On the other hand, in the case of traditional cyclotrons, a large proportion of the power is utilized for the purpose of generating and shaping the magnetic field required for the acceleration of the particles.

There are currently in existence traditional cyclotrons referred to as "compact", which include only a single pole. In this case, the accelerating electrodes, which are generally called "dice", are disposed in the air gap. Consequently, the power supplied to the cyclotron must be relatively high, in order to establish the magnetic field in an air gap of increased size. On the other hand, the vacuum chamber is very simple and involves low cost.

There are also known traditional cyclotrons referred to as "in separate sectors", in which the magnetic structure is divided into sepacate units, which are entirely independent, in the form of sectors. The accelerating devices have been installed in the free spaces left between these "separate sectors". Consequently, the air gap of the magnetic sectors may be reduced and, in consequence of this, the number of amperes/revolution required for the purpose of generating the magnetic field is smaller.

However, these cyclotrons exhibit a series of difficulties. Firstly, each separate sector is equipped with a pair of windings. These windings are of complex shape (in the form of a sector) and, in order to release the free space between the sectors, they must be of minimal cross-section.

This demands that the current density must be high in these windings and, in consequence of this, the electrical power required for the purpose of generating the magnetic field remains high, even though the number of amperes/revolution is smaller.

Finally, as the sectors are mechanically independent, the mechanical design of the cyclotron, and in particular of the vacuum chamber, is complex and costly.

SUMMARY OF THE INVENTION

The object of the present invention is to provide a new type of non-superconductive cyclotron, in which the electrical power required for the purpose of generating the magnetic field is far smaller than in the abovementioned traditional cyclotrons, that is to say the "compact" cyclotron and the "separate sector" cyclotron.

This object may be achieved by a novel magnetic structure, in which there is provided a small air gap, which reduces the number of amperes/revolution required, but also a pair of substantially circular windings which are of large cross-section, which permits a reduction in the current density and thus in the electrical power required for the purpose of producing the number of amperes/revolution required.

Another object of the invention is to avoid, in the novel structure, the mechanical complexity inherent in the cyclotrons referred to as "having separate sectors".

This novel structure, specific to the traditional cyclotron, according to the invention is characterized in that it comprises at least three sectors called "hills", where the air gap is reduced to a dimension close to that of the accelerated beam and where the magnetic flux is substantially concentrated, separated by spaces in the form of sectors designated as "valleys", where the air gap has a very large dimension (for example, but in a non-limiting manner, where the air gap is of the order of 30 times greater than that of the hills), in order that the magnetic flux should be substantially zero, and by a single pair of substantially circular windings substantially surrounding the "hills" and the "valleys", flux returns being disposed outside the winding opposite the "hills", with a view to closing the magnetic circuit.

Another characteristic feature of the cyclotron according to the invention is that the sectors called "hills" are assembled in a rigid manner on two plates called "yokes" forming covering caps for the vacuum chamber and channelling the magnetic flux towards the abovementioned flux returns.

According to the invention, the cyclotron preferably includes four sectors of a traditional magnetic material.

A great advantage of the device according to the invention resides in the fact that the accelerating electrodes may be disposed in the "valleys" and that, in consequence of this, the air gap may be reduced to a minimum, that is to say to the space required for the circulation of the particles to be accelerated. This results in a considerable saving in the power consumed.

Another advantage of the cyclotron according to the principle of design of the invention resides in the simplicity of the windings which supply the magnetic induction field.

Geometries exhibiting similarities have already been described for superconductive cyclotrons by the documents U.S. Pat. No. 3,925,676; FR-A-2,234,733; IEEE Transactions on Nuclear Science Vol. NS-30 Aug., 4, 1983, Part 1, New York, USA pp. 2126–2128 E. ACERBI; and Nuclear Instruments & Methods in Physics Research, vol. 220 Feb., 1, 1984, Amsterdam, Netherlands, pp. 186–193 U. TRINKS.

However, the similarity between the abovementioned superconductive cyclotrons and the non-superconductive cyclotron according to the invention is limited to the geometry. The magnetic operation is fundamentally different.

In order to obtain a small number of amperes/revolution in the cyclotron according to the invention, the magnetic flux is concentrated in the "hills" where the air gap is a minimum and substantially zero in the "valleys" where the air gap is large.

In the superconductive cyclotrons of similar geometry, on the other hand, the steel is conpletely saturated and the magnetic flux is very large in the "valleys" as in the "hills" (cf. the reference Nuclear Instruments & Methods in Physics Research, vol. 220 Feb., 1, 1984 page 187, Table 1) and the desired effect, i.e. a reduction in the number of ampere revolulutions, is not achieved.

Moreover, contrary to the existing traditional cyclotrons, the structure has a symmetry of revolution, with flux returns in the alignment of each one of the sectors, which completely eliminates the troublesome asymmetries of the magnetic field which are associated with the traditional designs.

Moreover, the design of the cyclotron according to the invention permits the accommodation of the accelerating electrodes with a vertical supporting beam, as well as the final stage of the power amplifier, directly in the "valleys". Advantageously, the plate of the electrode is inductively coupled with the chamber of the cyclotron. The stability of the system is only improved as a result of this.

Although such an inductive coupling has already been used in the traditional cyclotrons, it has never been used for the purpose of resolving the problems of variable charge in the high-intensity cyclotrons.

The traditional cyclotrons also rely on mountings of the accelerating electrodes on a vertical supporting beam which exhibits half-wavelength resonance. These chambers are generally excited using a high-frequency power generator, which is situated at a certain distance.

Moreover, in the case of the traditional cyclotrons, if the intensity of the beam accelerated by the cyclotron is such that the power of acceleration becomes comparable with the power dissipated by the Joule effect in the chambers, the apparent shunt impedence of the chamber is reduced, and the coupling system is detuned, involving the appearance of reflected power on the transmission line. This effect may give rise to instabilities in the beam/accelerating voltage interactive system.

BRIEF DESCRIPTION OF THE DRAWINGS

Other details and advantages will appear more clearly in the description which follows, accompanied by the figures, in which.

DESCRIPTION OF THE PREFERRED EMBODIMENT

Figure 1:
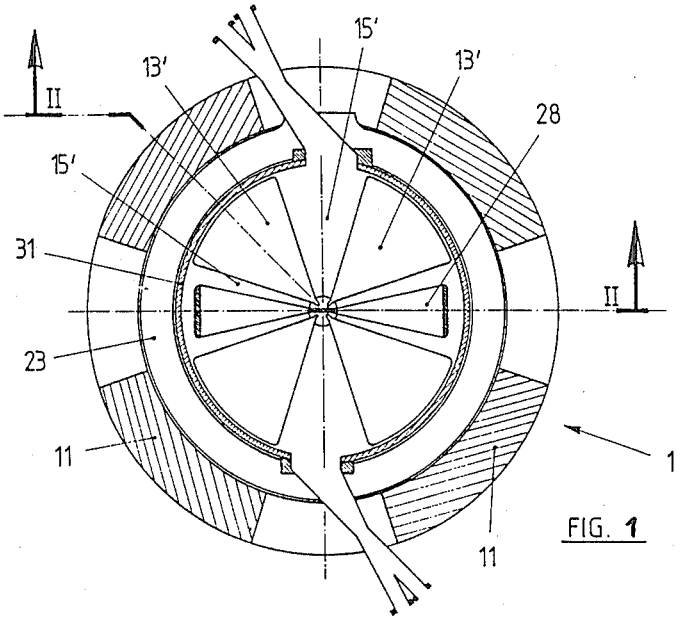
FIG. 1 shows a schematic cross-section in the median plane of a cyclotron according to the invention.
Figure 2:
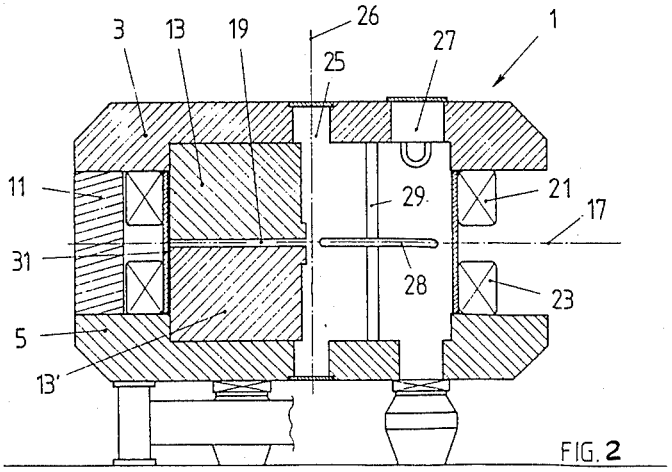
FIG. 2 shows a cross-sertion along the line II—II of FIG. 1.

It is clearly evident that the present description is given only by way of example, and that it is not intended to limit the scope of the present invention.

Ancilliary devices such as the outlet conduits, the base of the cyclotron and the vacuum pumps are mentioned by way of illustration, but are not specific to the cyclotron according to the invention. In the figures, identical reference characters designate identical or similar components.

The magnetic structure of the cyclotron exhibits a symmetry with respect to the plane in which the particles are accelerated, referred to as the "median plane" 17, which is, for example, located horizontally and with respect to an axis 26 perpendicular to this plane.

This magnetic structure is composed of a certain number of elements constructed of a ferromagnetic material (3, 5, 11, 13, 13') and of a pair of windings constructed of a conductive material (21, 23).

The ferromagnetic structure is composed of:

(1) Two base plates 3 and 5, called yokes, for example in the form of discs situated substantially in a configuration which is coaxial with respect to the axis 26, parallel and symmetrical with respect to the median plane 17, one being above the median plane and the other being below the latter.

(2) At least three upper sectors 13 and an equal number of lower sectors 13', situated one opposite the other, symmetrically with respect to the median plane 17, these being separated by a minimal air gap 19, that is to say one which is just adequate for the passage of the beam of particles, the magnetic flux being in this manner essentially concentrated at this location. The sectors 13 and 13' are rigidly fixed to the upper yoke 3 and the lower yoke 5, and are called hills.

(3) At least three flux returns 11 rigidly connecting the lower yoke 3 and the upper yoke 5, these flux returns being situated on the outside, opposite the sectors 13 and 13' and separated from the latter by a space having an annular shape, in which space the pair of windings 21, 23 is situated. In addition to the abovementioned mechanical function, these "flux returns" 11 ensure the return of the magnetic flux while maintaining access to the angular spaces 15 and 15' situated between the hills.

The windings 21 and 23 are of substantially circular shape and are localized in the annular space left between the sectors 13 and 13' and the flux returns 11. Advantageously, these windings have a large cross-section, which involves a low current density and thus a low electrical power dissipated for the purpose of generating the magnetic field.

The angular spaces 15 and 15', situated respectively between the sectors 13 and 13', are called "valleys". The air gap is large at this location, since it extends from the upper yoke 3 to the lower yoke 5. At this location, this air gap is, for example, of the order of 30 times greater than the air gap 19. The magnetic flux in the valleys is substantially zero.

The various constituent elements are assembled by means known per se, such as bolts.

The central passage 25 is intended to receive, at least in part, the source of particles to be accelerated, which are injected at the centre of the apparatus by means known per se.

In the case shown, i.e. that of a cyclotron having four sectors or having four "hills", the angle of a sector is advantageously of the order of 54°.

A cyclotron according to the invention advantageously includes the final stages of two high-frequency power amplifiers 27 coupled inductively by a loop with the accelerating electrodes 28 having a vertical supporting beam 29, which are accommodated in the "valleys" between the sectors 13, 13'.

In the cyclotron according to the invention, the vacuum chamber (31) can advantageously be very simple. It is composed of a ring of non-magnetic material, extending from the upper yoke 3 to the lower yoke 5 within the space left between the sectors 13, 13' and the windings 21, 23.

The advantage cf the simplicity of a pair of large windings and of the air gap reduced to a minimum will be noted; this enables large savings of energy to be obtained.

By way of example, it may be mentioned that, in the case of a cyclotron of energy of the order of 30 MeV, the air gap in the hills is 3 cm and the magnetic field is 18 kGs, while in the valleys the air gap is 106 cm and the magnetic field is 0.4 kGs. In this case, the number of ampere turns required is 33,000 At per winding; with a current density of 50 A/cm$^2$ in the windings, this gives a consumed power amounting to 7 kW for the cyclotron according to the invention, as against 100 kW for a normal cyclotron.

Let us note, by way of example, that for a superconductive cyclotron according to U.S. Pat. No. 3,925,676, the number of ampere turns required is $1.8 \cdot 10^6$ At per winding (column 4, lines 33 to 43).

We claim:

1. A non-superconductive cyclotron for accelerating a beam of particles in a magnetic flux, the accelerated particle beam having a pre-selected axial dimension, comprising:

magnetic circuit means having at least three sectors, said sectors defining hills;

spaces separating said hills, said spaces defining valleys;

a first air gap in said hills, said first air gap having an axial dimension close to the preselected axial dimension of the accelerated particle beam with the magnetic flux being essentially concentrated in said first gap;

a second air gap in said valleys, said second air gap having a very large axial dimension relative to said first air gap so that the magnetic flux in said second air gap is substantially zero; and a substantially circular single pair of annular windings substantially surrounding said hills and said valleys.

2. The cyclotron of claim 1 wherein:

said hills are rigidly fixed to a single component comprised of a ferromagnetic material.

3. The cyclotron of claim 1 wherein:

said axial dimension of said second air gap is about 30 times greater than said axial dimension of said first air gap.

4. The cyclotron of claim 1 wherein said magnetic circuit means further includes:

flux returns means attached to the exterior of said annular windings, said flux returns means being positioned opposite said hills.

5. The cyclotron of claim 1 wherein:

said hills have an angle of about 54°.

6. The cyclotron of claim 1 including:

accelerating electrode means in said valleys.

7. The cyclotron of claim 1 including:

a multi-stage power amplifier, said multi-stage power amplifier terminating at a final stage.

8. The cyclotron of claim 7 wherein:

said final stage of said power amplifier is mounted in said valleys.

9. The cyclotron of claim 6 including:

a multi-stage power amplifier, said multi-stage power amplifier terminating at a final stage.

10. The cyclotron of claim 9 wherein:

said final stage of said power amplifier is inductively coupled with said accelerating electrode means.

* * * * *